United States Patent [19]

Pichl

[11] 4,129,103

[45] Dec. 12, 1978

[54] MODULE UNIT

[75] Inventor: Heinz Pichl, Upsala, Sweden

[73] Assignee: AB Volvo Penta, Gothenburg, Sweden

[21] Appl. No.: 805,272

[22] Filed: Jun. 10, 1977

[30] Foreign Application Priority Data

Jun. 16, 1976 [SE] Sweden ..... 7606826

[51] Int. Cl.[2] ..... F02B 75/18

[52] U.S. Cl. ..... 123/52 R; 123/DIG. 7; 123/52 MC

[58] Field of Search ..... 123/DIG. 1, DIG. 6, 123/DIG. 8, DIG. 7, 52 MC, 190 A, 59 B, 52 M, 52 R

[56] References Cited

U.S. PATENT DOCUMENTS

| | | | |
|---|---|---|---|
| 1,890,584 | 12/1932 | Nardin | 123/59 B |
| 3,561,416 | 2/1971 | Kiekhaefer | 123/52 R |

FOREIGN PATENT DOCUMENTS

| | | | |
|---|---|---|---|
| 789342 | 1/1958 | United Kingdom | 123/DIG. 7 |

*Primary Examiner*—Ronald H. Lazarus

*Attorney, Agent, or Firm*—George H. Baldwin; Arthur G. Yeager

[57] ABSTRACT

Universal cast cylinder block module for forming Single and Multi-Cylinder Internal Combustion Engine.

14 Claims, 15 Drawing Figures

MODULE UNIT

Figure 1:
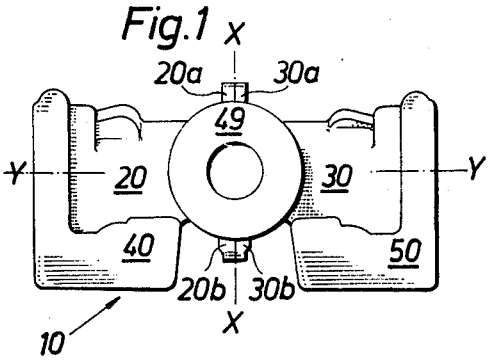

The present invention concerns a device for cast frameworks for liquid-cooled two-stroke engines and has an aim to produce a universal cast cylinder block unit module which through building together allows wide combination possibilities both with respect to the number of cylinders (one or multiple cylinder engines, to all intents and purposes with an unlimited number of cylinders) as with respect to the type of engine (in-line engines, V-engines, boxer or flat, opposed cylinder engines). The invention builds on the idea that such a unit module shall be producable e.g. in single cylinder, two cylinder, three cylinder performance etc. and also combinable arbitrarily both "lengthwise" (for example two-cylinder units behind one another to produce a four-cylinder in-line engine) as "crosswise" (e.g. the same two-cylinder units close to each other to produce a four-cylinder V-engine or opposite each other to produce a four-cylinder boxer engine), in doing which naturally both these ways could also be used simultaneously (e.g. so that from four two-cylinder units an eight-cylinder boxer engine can be built etc.). The present specification solves this in the accompanying main claim in the manner cited. According to the invention at hand, the separate unit modules differ from one another in principle only in the number of cylinders, that is to say whether they contain one cylinder or a certain higher number. Thanks to the device in the invention one can build in-line engines, V-engines and boxer engines in addition to single-cylinder engines, in a manner which will be described in more details later, with to all intents and purposes an arbitrary number of cylinders, with the help of a single type of unit module or a few types which differ from one another only in the number of cylinders, as has been stated above. Furthermore a great advantage in production of the ducts in the unit modules is achieved through the new device, since ducts which are open at both ends allow that at casting a core can easily be set up in the mould. Up till now, it was sometimes necessary that in casting the cylinder block, special openings had to be arranged only so that during casting the core should be able to be supported in a steady manner. This disadvantage is completely removed by this invention.

Both the frontal surfaces of the unit module have identical appearance, that is to say all ducts cast through the unit module end at both frontal surfaces at congruent points, so that at assembly of the unit modules in the axial direction, passages running through the whole engine are achieved without further measures. With "axial direction" we mean the direction of the crankshaft in this description and the accompanying patent claim. Irrespective of whether the motor consists of one or several unit modules, the frontal surfaces which make up the whole engine framework's first and last frontal surface must be sealed with respect to providing connecting flanges for the exhaust pipe etc. Both end plates serve for this purpose, but are not completely identical to one another. Each of the ducts running through the unit modules must of course be sealed outwards at one end, that is to say at the one end-plate, whereas that at the other end must show an inlet and outlet port, finally supplied with a connecting flange.

In principle the closure points and ports can be arbitrarily distributed between the two end plates with regard to the general construction of the engine, all ports should however be arranged with advantage at one end-plate, and the other be made completely sealed.

In order to make possible the application of the unit module for engines with both horizontal crankshafts (eg. inboard motors for boats) as well as those with vertical crankshafts (eg. outboard motors for boats) it is important that the cooling liquid outlet from the whole framework's uppermost unit module should lie uppermost in this unit. To this purpose a special cooling liquid discharge duct is arranged which does not directly communicate with any cooling jacket, but with a transmission channel, which in its turn is connected to the cooling liquid outlet from the outer cylinder. The transmission channel can be set up in the unit modules' frontal surface or in the endplate. There is no outlet port for the cooling liquid outlet in the end plate, where the transmission channel is found.

When the transmission channel is in the frontal surface, special plugs must be aranged for stopping up as connection between the outlet and the discharge duct is not desirable, eg. at the junction point between two unit modules joined axially to one another. With the arrangement of the transmission chanel in the end plate this drawback arises, however the end plate must generally be made somewhat thicker. The unit module in the invention can be devised for conventional attachments eg. by means of bolts and packing to a conventional crankshaft case, or it can be constructed also so that it itself includes the crankshaft case's upper part and is arranged to be fastened eg. in the above- named known way either to another identical unit module, so that a V- or boxer engine is produced or to a component which makes the crankshaft case's lower part (crank pit), so that a single-cylinder engine (when the unit module has only one cylinder) or an in-line engine (when the unit module has two or more cylinders) is produced.

All engine types, that is to say single-cylinder engines, in-line engines and boxer-engines in the invention can be built both with the help of a "smaller" unit module (without the crankshaft case part) and a complete crankshaft case, and with a "larger" unit module (with the upper crankshaft case part) and the crank pit part (lower crankshaft case part) or — in its place - another identical unit module. In order to be able to build V-engines from the "larger" unit modules, the limitation plane of the crankshaft case part must pass obliquely to the cylinder axis, as will be more closely described in the following.

In V-engines and boxer engines it is desirable as a rule for reasons of suitability that the driving rods from pistons in cylinders existing adjacent (V-engines) or opposite to each other (boxer engines) do not act on the crankshaft in the same plane, but in somewhat axially displaced positions, so that there is room alongside one another. Nevertheless, in order to be able to use identical cylinder blocks for both cylinder series in such engines, it is known to locate the drillings for the mounting bolts in such positions, that when two identical blocks turned through 180° are fastened to the crankshaft case, where the corresponding openings for both blocks are arranged in the identical axial position, these blocks will be disposed in the above-mentioned axially displaced position. This method is even applicable to the unit modules in the present invention, where it brings about the further advantage, that when two "larger" unit modules are screwed together directly to one another in a position turned through 180°, the axial displacement mentioned is automatically achieved. The special position of the drillings does not hereby disturb in any way the assembly of single-cylinder engines or in-line engines. The exhaust gas flue communicates with the cylinder or cylinders with advantage by means of exhaust gas channels lying obliquely in relation to the axial line of the exhaust gas flue. This means that, depending on which end the exhaust gas flue is to be obstructed in a given case, a smaller or larger gap is found in the exhaust gas flue between the mouth of the outer cylinder's exhaust gas channel or channels and the neighbouring frontal surface. In order to avoid flow disturbances in the exhaust gas flue, which can arise from this cause and/or through the different gradient of the exhaust gas channels, two different end plates are used with advantage which belong to the same type in the sense that they stop up the exhaust gas flue, but which have different lengths and differently shaped plug parts for the exhaust gas flue.

In order to be able to keep several cylinders producing a unit module in the invention as short as possible, it is advantageous to arrange the transfer ports in two neighbouring cylinders displaced in such a way that they lie alongside one another, looked at from a plane at right angles to the axes or the cylinders. In that way these transfer ports in two neighbouring cylinders in the main only take up the axial space, which otherwise each of them would take up.

Figure 4:
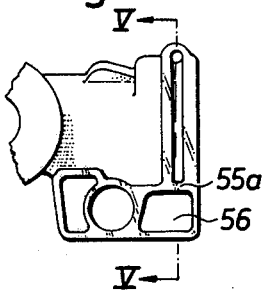
Figure 5:
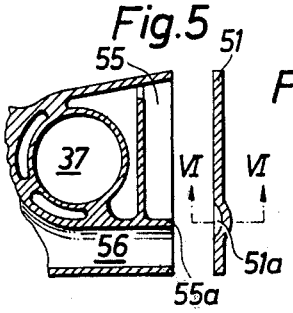
Figure 8:
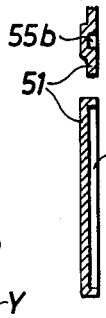
Figure 7:
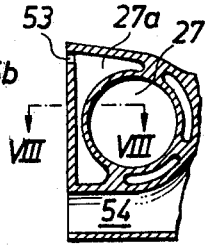
Figure 14:
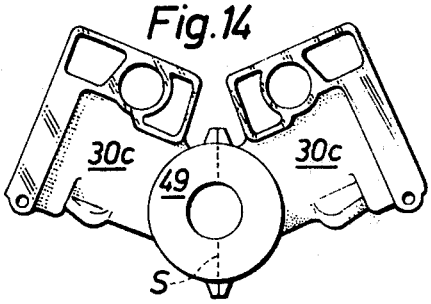
Figure 9:
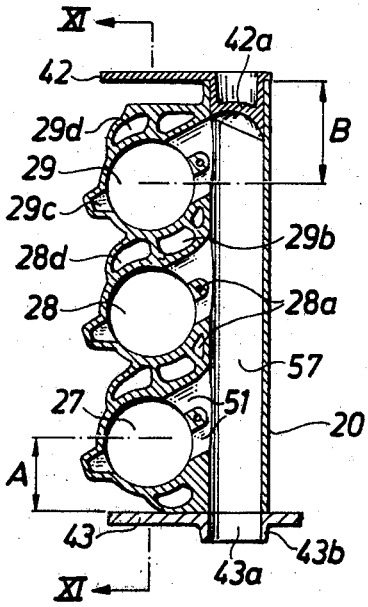
Figure 10:
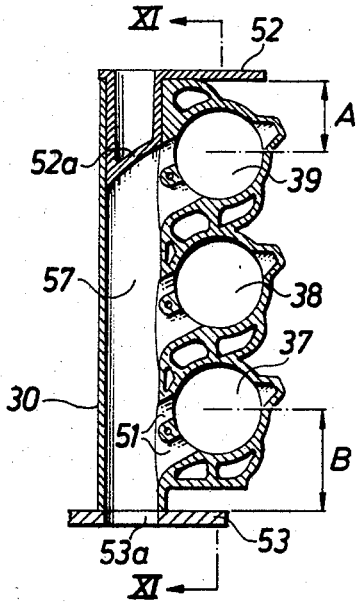
Figure 11:
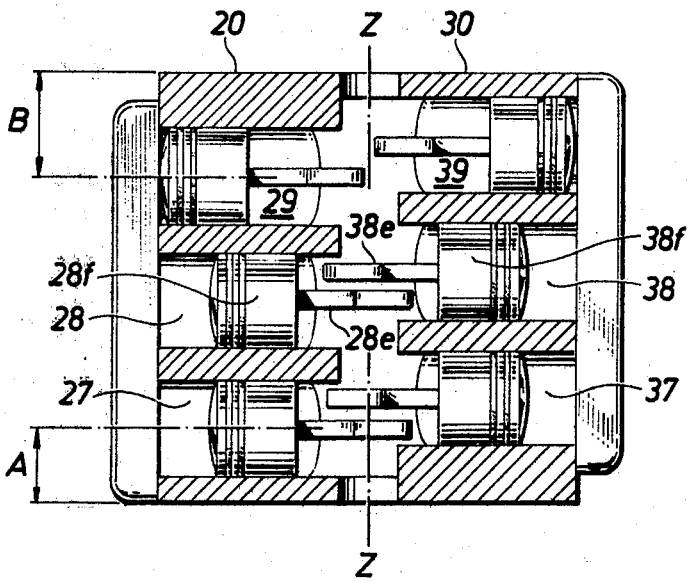
Figure 15:
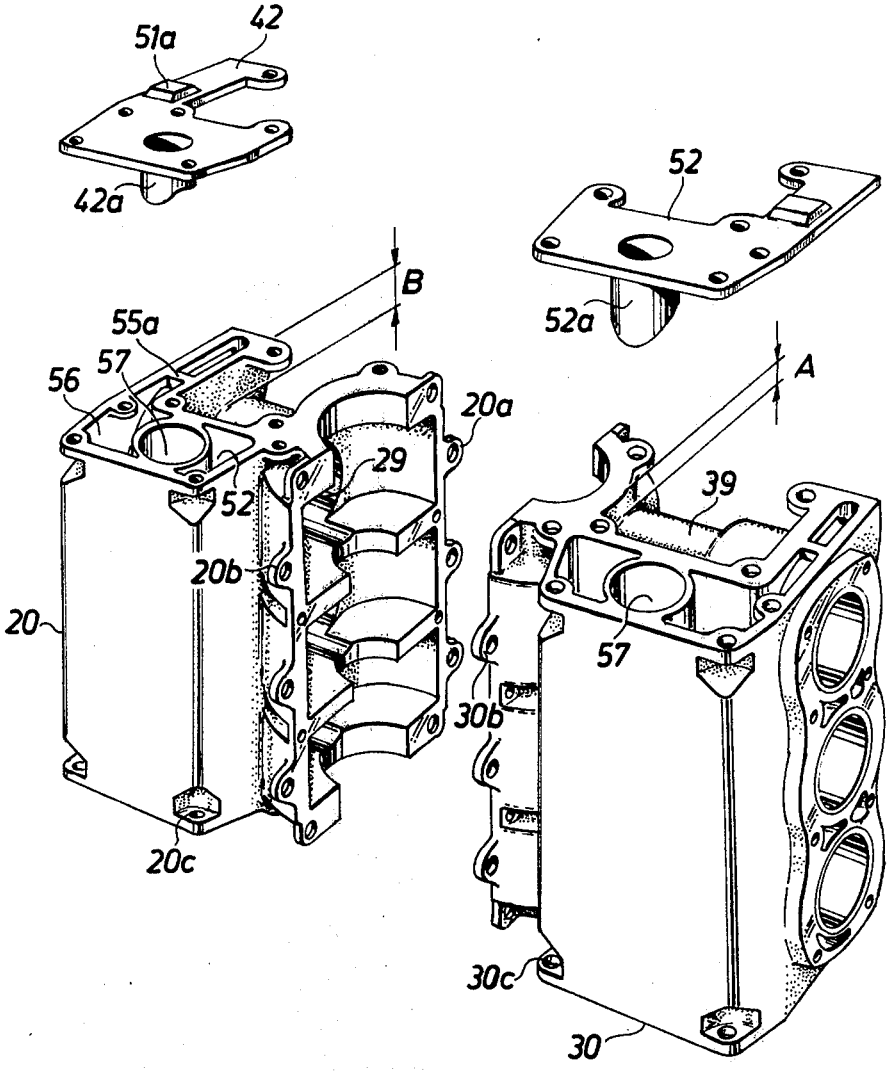

Further favourable characteristics of the invention appear from the following description of design examples together with the accompanying patent claim. The invention is more closely described with the help of the attached drawings, which show design examples, and in which FIG. 1 is a schematic front view of a six-cylinder boxer engine which is composed of two identical cylinder block unit modules turned through 180° according to the invention, FIG. 2 is the same view when the end plate have been taken off, FIG. 3 is a partial section along plane III—III in FIG. 2, FIG. 4 is a partial front view, similar to FIG. 2 from an alternate design, FIG. 5 is a partial section along plane V—V in FIG. 5 and similar to FIG. 3, FIG. 7 is a partial section along plane VII–VII in FIG. 2, and shows a part of the left unit module which is shown in FIG. 3 or 5, FIG. 8 is a partial section along plane VIII—VIII in FIG. 7, FIG. 9 and 10 are the sections passing in the axial direction through both the unit modules along planes IX—IX and X—X in FIG. 2, FIG. 11 is a diagrammatical section along the plane represented by the axle lines Y–y for the separate cylinders in FIG. 1 together with planes XI—XI in FIG. 9 and 10, FIG. 12 and 13 are diagrammatical front views of two designs of a single-cylinder engine or an in-line engine, FIG. 14 shows a V-engine which is made up of identical unit modules with an oblique limiting plane, and FIG. 15 is a perspective view of both unit modules in FIG. 1, 2, and 9, 10 with their corresponding upper end plates.

Figure 2:
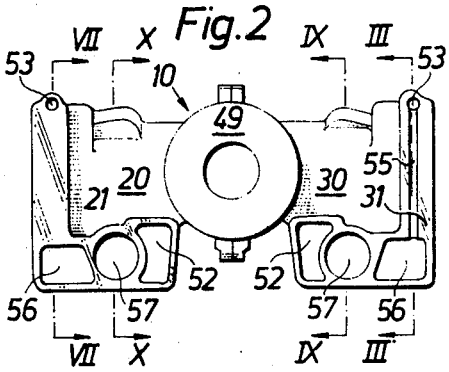

In accordance with FIG. 1 and 2, a two-stroke boxer engine 10 is in the main made up of two identical cylinder block unit modules 20, 30 which are of the larger type which also include the crankshaft case's upper part. In this description and in the accompanying patent claim the upper part of the crankshaft case means that part of the crankshaft case connecting with the cylinders. With the help of the flanges 20*a*, 30*a* and 20*b*, 30*b* together with mounting bolts seated in them (not shown), both unit modules 20, 30 are fastened to one another. The unit modules 20, 30 are of the type where the limiting plane X—X for their crankshaft case parts passes at right angles to the cylinder axes Y. The frontal surfaces of the unit modules in FIG. 1 which are not visible are covered by end plates 40, 50. In FIG. 2 the same engine is seen in the same view with the end plates 40, 50 removed so that the frontal surfaces 21, 31 by which the unit modules are terminated and on which the end plates 40, 50 are fastened (by bolts not shown) are visible. The crankshaft case part is covered by a cap 49.

In both frontal surfaces 21, 31 orifices for exahust gas flues are seen at 57, cooling liquid input ducts 52 and cooling liquid discharge ducts 56. It should be noted that both unit modules 21, 31 appear on their back sides (not shown) identical to their frontal surfaces, since in matter of fact one is talking about identical unit modules, turned through 180°. The cooling liquid input ducts 52 communicate via connections, not shown, with cooling jackets as 27*a*, 37*a* (FIG. 3, 5, 7,) in every cylinder 27–29, 37–39 (FIG. 9, 10) in the unit module. In both frontal surfaces 21, 31 the cooling liquid outlet 53 from a cooling jacket of outer cylinders 27, 29, 37, 39 (FIG. 9 and 10) is seen, which cooling jacket in its turn communicates directly that is to say without special ducts, with cooling jackets in all remaining cylinders in the unit module as in cylinders 28, 29 (FIG. 9 and 10). For synoptic reasons in FIG. 2, together with FIG. 3, 5 and 7, three different ways are seen in which the cooling liquid outlet 53 can communicate with the discharge duct 56, though in practice as a matter of course the same selected one of these arrangements would normally be used for throughout any one engine.

Figure 3:
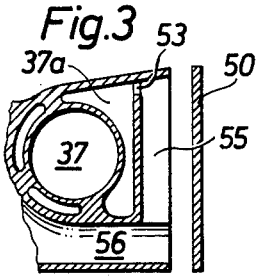

According to FIG. 2 and 3, the cooling jacket 37*a* in an outer cylinder 37 (lying nearest the frontal surface 21) communicates by means of a cooling liquid outlet 53 with a transmission channel 55 which is completely included in the unit module itself. The end plate 50 also covers the transmission channel 55, but does not cut it off.

When in the axial joining of two unit modules, as with the lower frontal surface (not seen) in the unit module 30 in FIG. 2, communication between the outlet 53 and the discharge duct 56 should not be allowed, a suitable plug (not visible) must be used to break off this communication, where appropriate arranged by the end plate.

Figure 6:
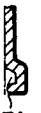

An alternative solution is seen in FIG. 4–6. Between the transmission channel 55 and the discharge duct 56 there is a partition 55a, which by the use of an end-plate 50 (FIG. 3) with plane surface produces a cut-off in communication between the outlet 53 and the discharge duct 56. By using another end plate 51 with an overflow 51*a*, communication is thus restored. In FIG. 6 the overflow 51*a* is seen in section along the plane VI—VI in FIG. 5.

On the left side of FIG. 2, also in FIG. 7 and 8 a design is shown where the transmission channel is arranged completely in an end plate 51. The outlet 53 from the outer cylinder's (27) cooling jacket 27*a* leads into the level frontal surface 21. If a flat or planar surfaced end plate as 50 in FIG. 3, or also an identical frontal surface in an associated unit module is tightly screwed onto this frontal surface, obviously no communication exists between the outlet 53 and the discharge duct 56. If it is desired that such a communication be achieved, that is to say at the engine's uppermost frontal surface, an end plate 51 in FIG. 7 and 8 is used instead. It is however obvious that eg. when the unit modules will only be used for in-line, boxer or V- engines without axial coupling, the outlet 53 can communicate out directly via a port in the end plate, and the transmission channel 55 and discharge duct 56 can be omitted.

In FIG. 9 and 10, sections through the engine in FIG. 2 are shown along the planes IX—IX and X—X in FIG. 2. The exhaust gas flues 57 communicate with the cylinders 27–29 and 37–39 by means of exhaust gas channels 51 which run obliquely to the axle lines of the exhaust gas flues 57. Since it is a question of two identical unit modules 20, 30 turned through 180°, the exhaust gas channels in the designs pass in the one unit module 20 obliquely upwards and in the other unit module 30 obliquely downwards (FIG. 10).

In contrast to FIG. 1, in FIG. 9 and 10 unit modules 20 and 30 are seen provided with completely sealed end plates 42, 52 at the back side, not shown in FIG. 1, while in FIG 1 completely sealed end plates 40, 50 have been shown from the front. Although under these conditions both exhaust gas flues 57 will be stopped up to the rear of the end plates (as in the unit module 20 in FIG. 9, and in the unit module 30 in FIG. 10), it is advantageous to use different end plates 42 and 52 which differ only in the position and slope with respect to the profile of the plug elements **42*a*, 52*a* which are adapted to give the best possible flow conditions for the exhaust gases flowing from the exhaust gas channels 51 of the outer cylinders 29, 39. At the bottom of FIG. 9 and 10 the unit modules 20 and 30 are closed by end plates 43, 53 with outlet ports 43*a* and 53*a* for exhaust gas flues 57, to which ports the exhaust gas pipe can be closed off by means of flanges or connection pieces such as 43*b* in FIG. 9. Further, it is evident from FIG. 9 and FIG. 10, how some gas transmission channels of the cylinders 27–29 and 37–39 "cover over" one another. Each cylinder is provided with three gas transmission channels, as eg. the cylinder 29 with gas transmission channels 29*b*, 29*c*, 29*d*. Here the gas transmission channel 29*b* is arranged in juxtaposition with and in inward overlapping relation to, and so that it occupies substantially the same axial space as, the gas transmission channel 28d of the neighbouring cylinder 28** etc. By this, a reduction in the axial length of the whole unit module is attained.

In FIG. 9 and 10, only such parts of the cooling jacket as **28*a*** are visible.

The distances A and B between one unit module's one outer cylinder, e.g. 27, and the other outer cylinder, 29, and the adjacent frontal surfaces are different. The purpose of this arrangement is evident from FIG. 11 which is a schematic section along that plane represented by the cylinder axle lines Y in FIG. 1. The crankshaft of the engine is symbolized in FIG. 11 by its symmetry axis line Z—Z. It is evident from the drawing that driving rods such as **28*e*, 38*e* of pistons such as 28*f*, 38*f*, which move in a pair of cylinders lying opposite to each other such as 28, 38** act on crankshafts in axially displaced positions, which simplifies the engine's construction. The same consideration is valid for a V-engine.

Figure 12:
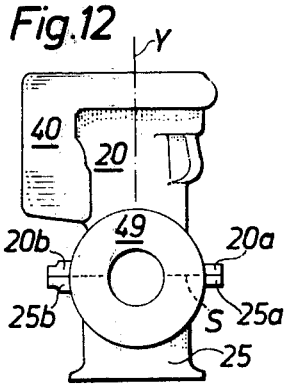
Figure 13:
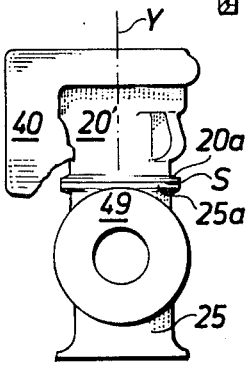

In FIG. 12 it is shown schematically how a single-cylinder engine or an in-line engine (depending of the number of cylinders in the unit module) can be made up from one (or more axially joined) unit modules of the "larger" type and a lower crankshaft case part 25 with binding flanges **25*a*, 25*b*. The dividing plane S between both the construction parts, that is to say the lower limiting plane of the unit module, passes at right angles to the axis or axes Y of the cylinder or cylinders. The same thing applies in the arrangement in FIG. 13, nevertheless the engine is made up here of one or more axially lined up smaller unit modules 20' and one complete crankshaft case part 25'. In FIG. 14 it is shown schematically how with the help of two identical "larger" unit modules 30c with obliquely running limiting surfaces, a V-engine can be made up. From the drawing it is evident that when one of the unit modules 30*c*** is turned through 180° round e.g. its central cylinder axis line relative to the other unit module, then a boxer motor is produced.

In the perspective view in FIG. 15, the same reference numbers are given for identical construction parts as in the foregoing design figures, where however the characteristics shown in various earlier figures have been gathered together in the same diagram, as e.g. the overflow **51*a* (FIG. 5) and the stopper elements 42*a*, 52*a* (FIG. 9 and 10**).

The downward displaced position in the respective crankshaft case section of cylinder 37 etc. may be noted, to which an upward displacement in the unit module 30 corresponds which is not visible in the drawing, so that in the joining of the unit modules with the help of flanges such as **20*a*, 20*b*, 30*b* etc. the cylinder axes from the one and from the other unit module meet the crankshaft at various heights. From the drawing, it is evident that it is also possible to join the same two unit modules 20, 30 in such a way that the stated cylinder axles meet the crankshaft in identical axial positions, one imagines the unit module 30 which is identical with unit module 20**, turns through 180° round the central axis of the cylinder.

To bring about a good prospect of joining together many unit modules axially, pockets such as **20*c*, 30*c*** are set up for fastening bolts.

I claim:

1. Device concerning cast cylinder blocks for liquid-cooled two-stroke engines, characterised by the facility for the putting together of engines with various numbers of cylinders and of various types, the cylinder block comprises at least one unit module cast in one piece (20, 30) which comprises at least one cylinder part including cooling jacket (**27*a*) and transmission channel or channels (29 *b-d*), and further one through exhaust gas flue (57) with both its end open and communicating within the unit module by means of at least one exhaust gas channel (51) with each cylinder (27–29, 37–39), one through cooling liquid duct (52) communicating within the unit module with each cooling jacket and with both its end open, and one through cooling liquid outlet (53) communicating at least with the cooling jacket in an outer cylinder (27), that the unit module shows plane frontal surfaces (21, 31) on its front and back sides in the axial direction, which are arranged for connection to an identical frontal surface in other corresponding unit modules or to a special end plate (40 — 42, 50—52) and in which the mentioned ducts and the cooling liquid outlet end in identical positions, so that with joining in the axial direction of many unit modules, through passages at least for exhaust gases and fed-in cooling liquid are produced, and that for the closure of the framework's first and last frontal surface two end plates exist which are so arranged that they complement each other in the meaning that when the one closes off one duct, the other produces a port for the same duct, preferably provided with a connection possibility (43***b*) for a pipe or a hose, and vice-versa.

2. Device in patent claim 1, characterised by the fact that the unit module shows further a through cooling liquid discharge duct (56) not communicating with any cooling jacket and with both ends open, at which at neither end plate any outlet port for the cooling liquid outlet is arranged, and where no outlet duct port is arranged in the frontal surfaces and/or in the end plates, a transmission channel (55) between the cooling liquid outlet and the outlet duct is arranged.

3. Device in claim 2 with the transmission channel in the frontal surfaces characterised by plugs for introduction into the transmission channel at the frontal surface, where the connection with the cooling liquid outlet is not desired.

4. Device in accord with claim 1, characterised by the fact that the one end plate contains all ports and the other is arranged to seal off all ducts.

5. Device in accord with claim 1 characterised by the fact that the unit module (20') is arranged for fastening onto a crankshaft case (25').

6. Device in accord with claim 1, characterised by the fact that the unit module (20, 20*a*) contains even the upper part of the crankshaft case and is arranged to be fastened either to an identical unit module to produce a boxer engine or a V-engine, or to the lower part of the crankshaft case (25).

7. Device in accord with claim 1 characterised by the fact that both the frontal surfaces in the unit module are arranged at various distances (A,B) from the cylinders (27,29,37,39) and that the fastening device or hole for fastening bolts etc., are arranged in a known way in such positions that two identical unit modules, turned through 180°, can be used for building up a V-engine or a boxer engine where the driving rods from the pistons in cylinders adjoining or lying just opposite each other act on the crankshaft in the axially displaced position (FIG. 11).

8. Device in accord with claim 1 characterised by the fact that the exhaust gas channels (51) pass obliquely to the axle line of the exhaust gas flue and that especially the end plates (42,52) be found with a closure element (42*a*, 52*a*), that on the stopping up of the exhaust gas flue from either side an even gas flow is achieved at the mouth of the outermost exhaust gas channel in the exhaust gas flue.

9. Device in accord with claim 1 characterised by the fact that said unit module comprises two side-by-side neighbouring cylinders having parallel axes, that the axial length of the unit module is minimized in that the transmission channels (28*d*, 29*b*) of said two neighbouring cylinders (28,29) are arranged in sideways-displaced positions so that they in the main lie beside each other, seen at right angles to the axes of said two cylinders.

10. Device in accord with claim 6, characterised by the fact that the plane surface (S) which limits the crankshaft case part (20*c*, 30*c*) of the unit module passes obliquely to the cylinder axis of the unit module in such a way that two identical such unit modules in firstly a reciprocal position complement each other to make a V-motor, and secondly when one such module has been turned 180° around its cylinder axis from such reciprocal position to make a boxer motor.

11. A cast cylinder block unit module for a liquid cooled two cycle internal combustion engine comprising a body provided with a combustion cylinder cavity and a hollow jacket for cooling liquid surrounding said cavity, said body having two opposite planar faces parallel to each other and to the axis of said cylinder cavity, said body being further provided with at least one rectilinear cooling liquid channel extending perpendicularly to and opening at respectively opposite ends through said respective faces and with a rectilinear exhaust duct extending perpendicularly to and opening at respectively opposite ends through said respective faces, said body further comprising a passage connecting between the interior of said jacket and said channel between its said ends and an exhaust channel connecting said cavity to said duct between its said ends.

12. In a set of elements for assembly into a liquid-cooled two-cycle internal combustion engine, at least one cast cylinder block unit comprising a body provided with a combustion cylinder cavity and a hollow jacket for cooling liquid surrounding said cavity, said body having two opposite planar faces parallel to each other and to the axis of said cylinder cavity, said unit being further provided with at least one rectilinear cooling liquid channel extending perpendicularly to and opening at respectively opposite ends through said respective faces and with a rectilinear exhaust duct extending perpendicularly to and opening at respectively opposite ends through said respective faces, said unit further comprising a passage connecting between the interior of said jacket and said channel between its said ends and an exhaust channel connecting said cavity to said duct between its said ends, a first and a second end plate, each said plate comprising a planar surface for seating coveringly against one and the other of said opposite planar surfaces of said block unit, said first end plate being provided with a cooling liquid port therethrough alignable with said channel at one said end thereof, said second plate including a portion for sealing off said channel at the opposite said end thereof, one of said end plates being provided with an exhaust gas outlet port alignable with one said duct and the other of said end plates including a portion for closing the other said end of said duct.

13. The combination according to claim 12 wherein said other end plate includes a plug portion extending outwardly from its said planar surface fittingly receivable into said duct through said other end of said duct.

14. The combination according to claim 12 wherein said planar faces of said body are substantially mirror images of each other and said planar surfaces of said end plates are substantially mirror images of each other.

* * * * *